US008417168B2

(12) United States Patent
Nakatsuhara et al.

(10) Patent No.: US 8,417,168 B2
(45) Date of Patent: Apr. 9, 2013

(54) FIXING DEVICE HAVING A THERMAL-INSULATION MEMBER PROVIDED ON A PLATE PORTION FOR GUIDING RECORDING MEDIUM, AND IMAGE FORMING APPARATUS

(75) Inventors: Masaya Nakatsuhara, Ebina (JP); Yuichi Fukuda, Ebina (JP); Sho Watanabe, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 138 days.

(21) Appl. No.: 12/781,285

(22) Filed: May 17, 2010

(65) Prior Publication Data

US 2011/0142469 A1 Jun. 16, 2011

(30) Foreign Application Priority Data

Dec. 11, 2009 (JP) ..... 2009-282056

(51) Int. Cl.
*G03G 15/20* (2006.01)

(52) U.S. Cl.
USPC ..... 399/323

(58) Field of Classification Search ..... 399/69, 399/323, 322, 329, 406; 219/216
See application file for complete search history.

(56) References Cited

U.S. PATENT DOCUMENTS

| | | | | |
|---|---|---|---|---|
| 5,528,351 | A * | 6/1996 | Tsuji | 399/322 |
| 2004/0005177 | A1 * | 1/2004 | Oyama | 399/328 |
| 2006/0198670 | A1 * | 9/2006 | Baba et al. | 399/323 |

FOREIGN PATENT DOCUMENTS

| | | | |
|---|---|---|---|
| JP | 02132481 | A * | 5/1990 |
| JP | A-9-305058 | | 11/1997 |
| JP | 2001-249562 | * | 9/2001 |
| JP | A-2004-286992 | | 10/2004 |
| JP | A-2005-128446 | | 5/2005 |
| JP | A-2006-195344 | | 7/2006 |

* cited by examiner

*Primary Examiner* — Walter L Lindsay, Jr.
*Assistant Examiner* — Billy J Lactaoen
(74) *Attorney, Agent, or Firm* — Oliff & Berridge, PLC

(57) ABSTRACT

A fixing device includes: a fixing member that fixes a toner image on a recording medium; a pressure member that comes into pressure-contact with an outer peripheral surface of the fixing member and thereby forms a fixing pressure portion between the pressure member and the fixing member, the fixing pressure portion allowing the recording medium carrying an unfixed toner image to pass therethrough; a tension member that is arranged to face the pressure member with the fixing member interposed therebetween, and tensions the fixing member; a peeling member that is arranged at a position downstream of the fixing pressure portion in a recording medium transport direction and adjacent to the tension member, and peels the recording medium from the fixing member; and an exit guide member that guides the recording medium while keeping a temperature of the recording medium, after the recording medium passes through the fixing pressure portion.

6 Claims, 6 Drawing Sheets

FIXING DEVICE HAVING A THERMAL-INSULATION MEMBER PROVIDED ON A PLATE PORTION FOR GUIDING RECORDING MEDIUM, AND IMAGE FORMING APPARATUS

CROSS REFERENCE TO RELATED APPLICATIONS

This application is based on and claims priority under 35 USC §119 from Japanese Patent Application No. 2009-282056 filed Dec. 11, 2009.

BACKGROUND

1. Technical Field

The present invention relates to a fixing device and an image forming apparatus.

2. Related Art

As a fixing device used for an image forming apparatus of a copying machine or a printer, one such device having a heating member constituted by a belt member (a fixing belt) provided with tension by plural rollers is known.

SUMMARY

According to an aspect of the present invention, there is provided a fixing device including: a fixing member that fixes a toner image on a recording medium; a pressure member that comes into pressure-contact with an outer peripheral surface of the fixing member and thereby forms a fixing pressure portion between the pressure member and the fixing member, the fixing pressure portion allowing the recording medium carrying an unfixed toner image to pass therethrough; a tension member that is arranged to face the pressure member with the fixing member interposed therebetween, and tensions the fixing member; a peeling member that is arranged at a position downstream of the fixing pressure portion in a recording medium transport direction and adjacent to the tension member, and peels the recording medium from the fixing member; and an exit guide member that guides the recording medium while keeping a temperature of the recording medium, after the recording medium passes through the fixing pressure portion.

BRIEF DESCRIPTION OF THE DRAWINGS

Exemplary embodiment of the present invention will be described in detail based on the following figures, wherein.

DETAILED DESCRIPTION

An exemplary embodiment of the present invention is described below in detail with reference to the accompanying drawings.

<Explanation of Image Forming Apparatus>

Figure 1:
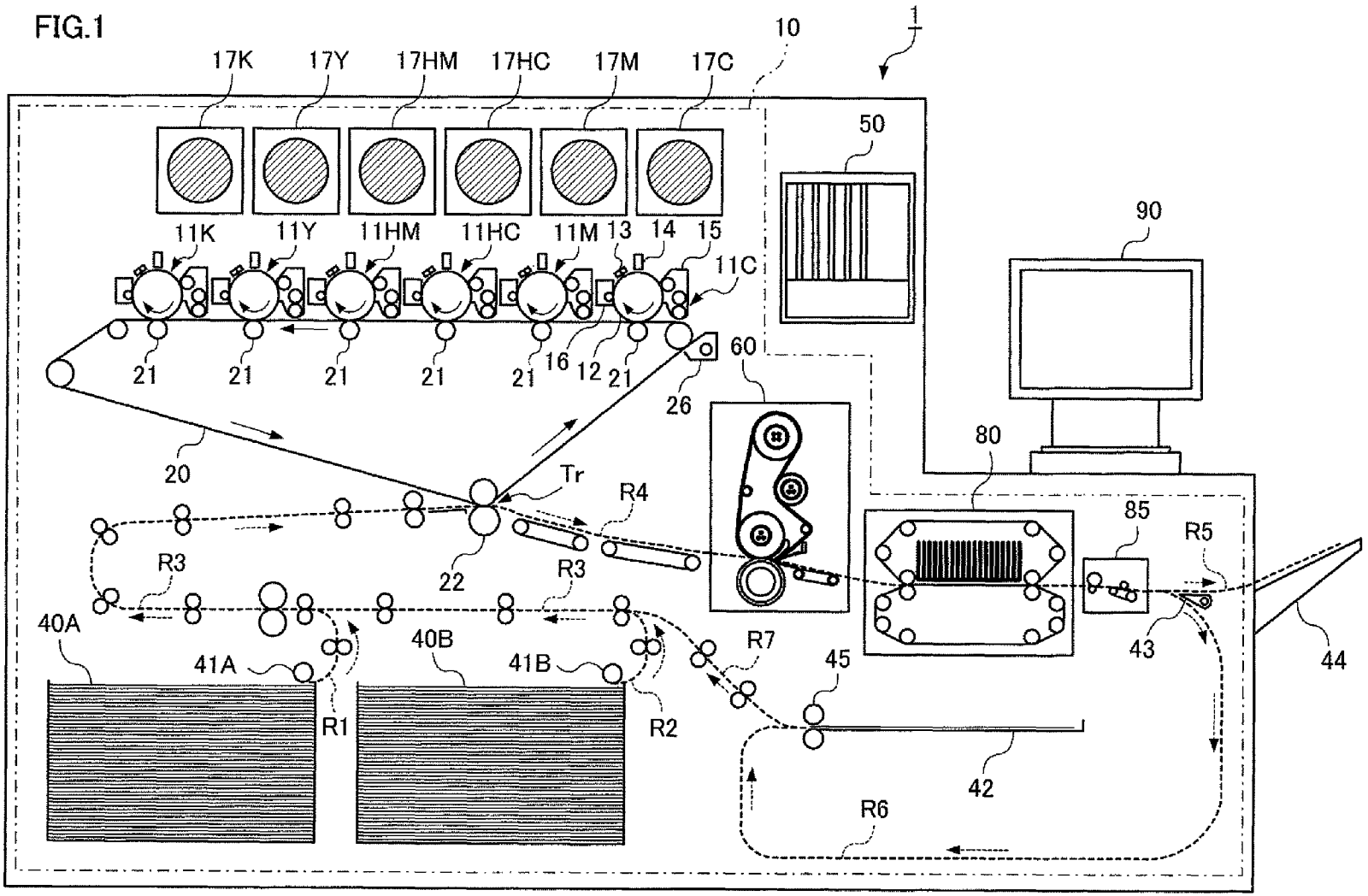
FIG. 1 is a diagram showing a configuration example of an image forming apparatus to which a fixing device according to a present exemplary embodiment is applied.

FIG. 1 is a diagram showing a configuration example of an image forming apparatus 1 to which a fixing unit (fixing device) 60 according to the present exemplary embodiment is applied. The image forming apparatus 1 shown in FIG. 1 is a so-called "tandem-type" color printer, and includes: an image forming portion 10 which forms an image on the basis of image data; a main controller 50 which controls operations of the entire image forming apparatus 1, performs communications with a personal computer (PC) and performs image processing on image data and the like, for example; and a user interface (UI) unit 90 which accepts an input operation made by the user and displays various information for the user.

<Explanation of Image Forming Unit>

The image forming portion 10 is a functional portion which forms an image through an electrophotographic system for example, and includes six image forming units 11C, 11M, 11HC, 11HM, 11Y, and 11K (hereinafter, also referred to as "image forming units 11" collectively), which are arranged in parallel, as an example of a toner image forming unit. For example, each of the image forming units 11 includes, as functional members: a photoconductive drum 12 on which an electrostatic latent image is formed and thereafter a toner image of each color is formed; a charging device 13 which charges the surface of the photoconductive drum 12 at a predetermined electric potential; an exposure device 14 which exposes the photoconductive drum 12 on the basis of image data, the photoconductive drum 12 charged by the charging device 13; a developing device 15 which develops the electrostatic latent image formed on the photoconductive drum 12 by using a toner of each color; and a cleaner 16 which cleans the surface of the photoconductive drum 12 after transfer.

The developing devices 15 of the respective image forming units 11 are connected through toner transport paths (not shown) to toner containers 17C, 17M, 17HC, 17HM, 17Y, and 17K (hereinafter, also referred to as "toner containers 17" collectively), and are configured to be refilled with color toners from the toner containers 17 through refill screws (not shown) provided in the toner transport paths. Here, the toner containers 17 store the respective color toners.

The image forming units 11 have substantially similar configurations except toners housed in the respective developing devices 15, and form toner images of the respective colors of cyan (C), magenta (M), high-saturation cyan (HC), high-saturation magenta (HM), yellow (Y) and black (K). Here, HC has a hue of cyan, and has a light color tone and high saturation relative to those of C. HM has a hue of magenta, and has a light color tone and high saturation relative to those of M.

The image forming portion 10 also includes: an intermediate transfer belt 20 on which the color toner images formed on the photoconductive drums 12 of the respective image forming units 11 are transferred; primary-transfer rollers 21 which transfer the color toner images on the intermediate transfer belt 20 (primary transfer), the color toner images being formed by the image forming units 11; a secondary-transfer roller 22 which collectively transfers, to a sheet that is a recording medium (recording sheet), the color toner images transferred on the intermediate transfer belt 20 in a superimposing manner (secondary transfer); and the fixing unit 60 as an example of a fixing unit (fixing device) which fixes the secondary-transferred color toner images on the sheet.

In addition, the image forming portion 10 includes: a cooling unit 80 which cools the color toner images fixed on the sheet by the fixing unit 60 so as to facilitate the fixing of the color toner images on the sheet; and a curl correcting unit 85 which corrects curl of the sheet.

Note that, in the image forming apparatus 1 of the present exemplary embodiment, the intermediate transfer belt 20, the primary-transfer rollers 21 and the secondary-transfer roller 22 constitute a transfer unit. Further, hereinafter, a region in which the secondary-transfer roller 22 is placed to secondary-transfer the color toner images, which have been transferred on the intermediate transfer belt 20, onto the sheet will be referred to as "secondary-transfer region Tr".

<Explanation of Sheet Transporting System>

The image forming portion 10 also includes, as a sheet transporting system: multiple (two in the present exemplary embodiment) sheet containers 40A and 40B which house sheets therein; feed rollers 41A and 41B which feed and transport sheets housed in the sheet containers 40A and 4013; a first transport path R1 which is used for transporting a sheet fed from the sheet container 40A; a second transport path R2 which is used for transporting a sheet fed from the sheet container 40B; a third transport path R3 which is used for transporting the sheet fed from the sheet container 40A or 40B toward the secondary-transfer region Tr; a fourth transport path R4 which is used for transporting the sheet, on which the color toner images are transferred in the secondary-transfer region Tr, so as to cause the sheet to pass through the fixing unit 60, the cooling unit 80 and the curl correcting unit 85; and a fifth transport path R5 which is used for transporting the sheet from the curl correcting unit 85 toward a sheet stacking unit 44 provided to an output portion of the image forming apparatus 1.

Transfer rollers or transfer belts are arranged on each of the first to fifth transport paths R1 to R5 to sequentially transport sheets fed on their corresponding path.

<Explanation of Duplex Transporting System>

The image forming portion 10 also includes, as a duplex transporting system: an intermediate sheet container 42 which once holds a sheet on a first surface of which the color toner images are fixed by the fixing unit 60; a sixth transport path R6 which is used for transporting a sheet from the curl correcting unit 85 toward the intermediate sheet container 42; a seventh transport path R7 which is used for transporting a sheet housed in the intermediate sheet container 42 toward the third transport path R3; a routing mechanism 43 which is arranged downstream of the curl correcting unit 85 in a sheet transport direction, and selects the route of a sheet between the fifth transport path R5 and the sixth transport path R6, the fifth transport path R5 used for transporting the sheet toward the sheet stacking unit 44, the sixth transport path R6 used for transporting the sheet toward the intermediate sheet container 42; feed rollers 45 which feed a sheet housed in the intermediate sheet container 42 and transport the sheet toward the seventh transport path R7.

<Explanation of Image Forming Operation>

Next, a basic image forming operation performed by the image forming apparatus 1 according to the present exemplary embodiment is described.

The image forming units 11 of the image forming portion 10 form toner images of the respective colors of C, M, HC, HM, Y and K with an electrophotographic process using the functional members described above. The color toner images formed by the respective image forming units 11 are primary-transferred on the intermediate transfer belt 20 sequentially by the primary-transfer rollers 21, so that a combined toner image in which the color toners are superimposed is formed. With the movement of the intermediate transfer belt 20 (in its arrow direction), the combined toner image on the intermediate transfer belt 20 is transported to the secondary-transfer region Tr in which the secondary-transfer roller 22 is arranged.

Meanwhile, in the sheet transporting system, the feed rollers 41A and 41B rotate in concert with the start timing of the image forming operation performed by the image forming units 11. Thus, one of sheets in the sheet container 40A or 40B is fed by the corresponding feed roller 41. Here, the selection between the sheet containers 40A and 40B is made through the UI unit 90, for example. The sheet fed by the feed roller 41A or 41B is transported to the secondary-transfer region Tr along the first transport path R1 or the second transport path R2, and the third transport path R3.

In the secondary-transfer region Tr, the combined toner image held on the intermediate transfer belt 20 is secondary-transferred on the sheet collectively with a transfer electric field formed by the secondary-transfer roller 22.

The sheet on which the combined toner image is transferred is thereafter separated from the intermediate transfer belt 20, and transported to the fixing unit 60 along the fourth transport path R4. The fixing unit 60 performs a fixing process on the combined toner image formed on the sheet transported thereto, and thereby fixes the toner image on the sheet. The sheet having the fixed image formed thereon is then cooled by the cooling unit 80, and its curl is corrected by the curl correcting unit 85. The sheet having passed through the curl correcting unit 85 is thereafter routed by the routing mechanism 43. In the case of simplex printing, the sheet is guided to the fifth transport path R5 so as to be transported toward the sheet stacking unit 44.

Note that, the toner attached to each photoconductive drum 12 after the primary transfer (primary-transfer residual toner) is removed by the corresponding cleaner 16, and the toner attached to the intermediate transfer belt 20 after the secondary transfer (secondary-transfer residual toner) is removed by a belt cleaner 26.

In the case of duplex printing, the sheet, on the first surface of which the fixed image is formed through the aforementioned process, passes through the curl correcting unit 85 and is then guided by the routing mechanism 43 to the sixth transport path R6 so as to be transported toward the intermediate sheet container 42. Then, the feed rollers 45 rotate in concert with the start timing of an image forming operation for a second surface performed by the image forming units 11, and the sheet is thereby fed from the intermediate sheet container 42. The sheet fed by the feed rollers 45 is transported to the secondary-transfer region Tr along the seventh and third transport paths R7 and R3.

In the secondary-transfer region Tr, as in the case of the operation for the first surface, color toner images for the second surface which are held on the intermediate transfer belt 20 are secondary-transferred on the sheet collectively with a transfer electric field formed by the secondary-transfer roller 22.

The sheet, both surfaces of which the toner images are formed, is subjected to the fixing process by the fixing unit 60, cooled by the cooling unit 80, and its curl is corrected by the curl correcting unit 85, as in the case of the operation for the first surface. The sheet having passed through the curl correcting unit 85 is then guided by the routing mechanism 43 to the fifth transport path R5 so as to be transported toward the sheet stacking unit 44.

The image forming process of the image forming apparatus 1 is repeatedly performed in the aforementioned manner until cycles corresponding to the number of sheets to be printed have elapsed.

<Explanation of Configuration of Fixing Unit>

Next, the fixing unit 60 employed in the image forming apparatus 1 according to the present exemplary embodiment is described.

Figure 2:
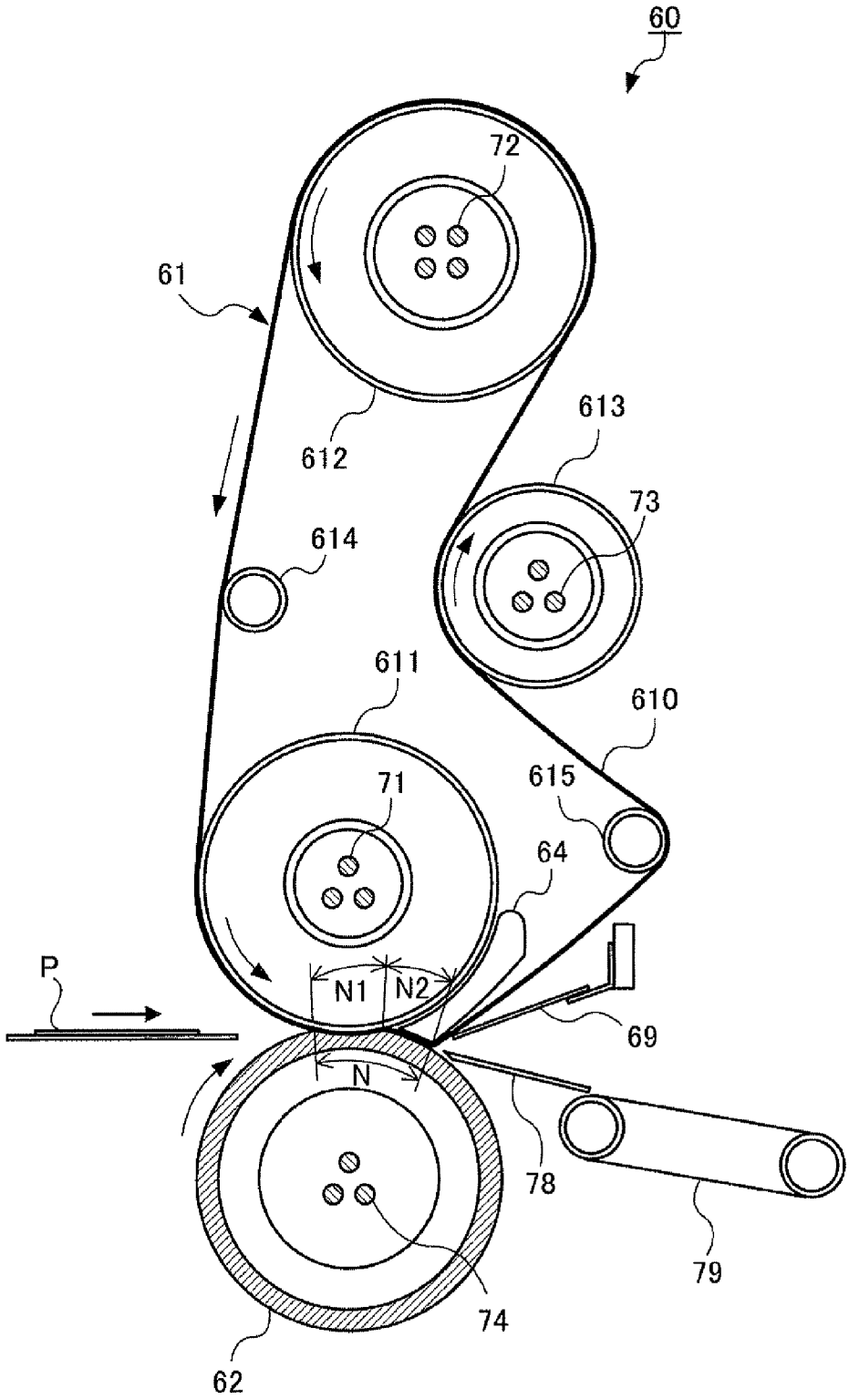
FIG. 2 is a sectional configuration diagram for illustrating a configuration of the fixing unit according to the present exemplary embodiment.

FIG. 2 is a sectional configuration diagram for illustrating a configuration of the fixing unit 60 according to the present exemplary embodiment. The fixing unit 60 is mainly formed of a fixing belt module 61, and a pressure roller 62 as an example of a pressure member which is configured in such a way that the pressure roller 62 may come into contact with and separate from the fixing belt module 61.

The fixing belt module 61 includes: a fixing belt 610 as an example of a fixing member which fixes a toner image on a sheet P; a fixing roller 611 as one of tension members which is arranged to face the pressure roller 62 with the fixing belt 610 interposed therebetween, rotates while tensioning the fixing belt 610, and heats the fixing belt 610 from the inner side thereof at a nip portion (fixing pressure portion) N that is a region where the fixing belt module 61 and the pressure roller 62 are in pressure-contact with each other (i.e., in contact with each other while pressing each other); an inner heating roller 612 as an example of an inner heating unit which heats the fixing belt 610 while tensioning the fixing belt 610 from the inner side thereof; an outer heating roller 613 as an example of an outer heating unit which heats the fixing belt 610 while tensioning the fixing belt 610 from the outer side thereof; a tension roller 614 which tensions the fixing belt 610 between the fixing roller 611 and the inner heating roller 612 (i.e., at the upstream side of the nip portion N in a belt movement direction); a peeling pad 64 as an example of a peeling member which is arranged downstream of the nip portion N in the belt movement direction and adjacent to the fixing roller 611; and a tension roller 615 which tensions the fixing belt 610 at the downstream side of the nip portion N in the belt movement direction.

The fixing belt 610 is formed of: a base layer which is made of polyimide resin; an elastic body layer which is stacked on the surface (outer peripheral surface) of the base layer and made of silicone rubber; and a release layer which covers the elastic body layer and is made of PFA (tetrafluoroethylene-perfluoroalkyl vinyl ether copolymer resin), for example. Here, the elastic body layer is provided for improving quality of color images in particular. To be more specific, the elastic body layer is provided for the following reason. A toner image held on the sheet P on which the toner image is to be fixed is formed by stacking powdery color toners. Accordingly, in order to uniformly heat the entire toner image at the nip portion N, the front surface of the fixing belt 610 may be deformed to follow the surface irregularities of the toner image on the sheet P.

The fixing roller 611 is a cylindrical roller made of aluminum or SUS, for example. The fixing roller 611 is rotated in its arrow direction in FIG. 2 by the rotational driving force of a driving motor not shown, and heated to a predetermined temperature (150° C., for example) by three halogen heaters 71, for example, as a heat source placed inside the fixing roller 611.

The inner heating roller 612 is a cylindrical roller made of aluminum or SUS, for example. The inner heating roller 612 is heated to a predetermined temperature (190° C., for example) by four halogen heaters 72, for example, as a heat source placed inside the inner heating roller 612.

Moreover, a spring member (not shown) is arranged at both end portions of the inner heating roller 612. The spring member presses the fixing belt 610 from the inner side thereof, and thereby sets the tension of the entire fixing belt 610 at, for example, 15 kgf.

The inner heating roller 612 is further provided with a mechanism for controlling the meandering (belt walk) of the fixing belt 610. Specifically, in the vicinity of the inner heating roller 612, a belt edge position detection mechanism (not shown) is arranged which detects positions of side end portions (edge positions) of the fixing belt 610. Moreover, the inner heating roller 612 is provided with a shifting mechanism (not shown) which shifts one end portion of the inner heating roller 612 in a direction orthogonal to the axial direction of the inner heating roller 612. The shifting mechanism performs the above shifting operation in accordance with a detection result by the belt edge position detection mechanism, and thereby shifts the fixing belt 610 in the axial direction of the inner heating roller 612. Consequently, the belt walk of the fixing belt 610 is controlled.

The outer heating roller 613 is a cylindrical roller made of aluminum or SUS, for example. The outer heating roller 613 is heated to a predetermined temperature (190° C., for example) by three halogen heaters 73, for example, as a heat source placed inside the outer heating roller 613.

As described above, the fixing unit 60 of the present exemplary embodiment employs a configuration in which the fixing belt 610 is heated by the fixing roller 611, the inner heating roller 612 and the outer heating roller 613.

The peeling pad 64 is a block member formed of a rigid body made of metal such as SUS or resin, for example, and having substantially an arc-shaped cross section. The peeling pad 64 is fixedly arranged over the entire area of the fixing roller 611 in its axial direction at a position downstream of and adjacent to a region where the pressure roller 62 is to come into pressure-contact with the fixing roller 611 with the fixing belt 610 interposed therebetween (such a region is hereinafter called a "roller nip portion N1"). The peeling pad 64 is arranged to uniformly press, at a predetermined load (at an average of 10 kgf, for example), the pressure roller 62 in a predetermined width region (over a nip width of 5 mm in the movement direction of the fixing belt 610, for example) with the fixing belt 610 interposed therebetween. Such a width region forms a "peeling pad nip portion N2" adjacent to the roller nip portion N1.

The pressure roller 62 is a member for forming the nip portion N by coming into pressure-contact with the outer peripheral surface of the fixing belt 610. Here, the nip portion N is formed for allowing the sheet P holding an unfixed toner image to pass through between the pressure roller 62 and the fixing belt 610. The pressure roller 62 has, as its base, a cylindrical roller made of aluminum or SUS, for example, and has an elastic layer made of silicone rubber, and a release layer made of a PFA tube which are stacked in this order from the base side. The pressure roller 62 is arranged in such a way that it may come into contact with and separate from the fixing belt module 61. When the pressure roller 62 is in contact with the fixing belt module 61 while pressing the fixing belt module 61 (i.e., in pressure-contact therewith), the pressure roller 62 is rotated with the rotation of the fixing roller 611 of the fixing belt module 61 in its arrow direction.

In the present exemplary embodiment, the pressure roller 62 also includes three halogen heaters 74, for example, as an example of a pressure member heating unit and as a heat source placed inside the pressure roller 62, and is thus heated to a predetermined temperature (90° C., for example).

<Explanation of Fixing Operation Performed by Fixing Unit>

Next, a fixing operation performed by the fixing unit 60 of the present exemplary embodiment is described.

In the image forming apparatus 1, a combined toner image (unfixed toner image) is electrostatically transferred on the sheet P in the secondary-transfer region Tr (see FIG. 1), and the sheet P is then transported toward the nip portion N (see FIG. 2) of the fixing unit 60 along the fourth transport path R4 (see FIG. 1). When the sheet P passes through the nip portion N, the unfixed toner image on the sheet P is fixed on the sheet P mainly by pressure and heat acting on the roller nip portion N1.

To be more specific, in the fixing unit 60 of the present exemplary embodiment, heat to act on the roller nip portion N1 is supplied mainly through the fixing belt 610. The fixing belt 610 is heated by: heat supplied by the halogen heaters 71 through the fixing roller 611 inside of which the fixing roller 611 is placed; heat supplied by the halogen heaters 72 through the inner heating roller 612 inside of which the inner heating roller 612 is placed; and heat supplied by the halogen heaters 73 through the outer heating roller 613 inside of which the outer heating roller 613 is placed. This configuration allows thermal energy to be supplied not only through the fixing roller 611 but also through the inner heating roller 612 and the outer heating roller 613. Accordingly, a sufficient amount of heat supply is secured in the roller nip portion N1 even at a high process speed.

In the fixing unit 60 of the present exemplary embodiment, the fixing belt 610 serving as a direct heating member may have a configuration with extremely low heat capacity. In addition, the fixing belt 610 is configured to be in contact with each of the fixing roller 611, the inner heating roller 612, and the outer heating roller 613, which are heat supplying members, in a large wrap area (wrap angle). This configuration allows a sufficient amount of heat to be supplied through the fixing roller 611, the inner heating roller 612, and the outer heating roller 613 in a short period in which the fixing belt 610 makes one rotation, and thereby allows the fixing belt 610 to come back to a required fixing temperature within a short time period. Hence, the predetermined fixing temperature is maintained in the roller nip portion N1.

As a consequence, with the fixing unit 60 of the present exemplary embodiment, a fixing temperature is maintained substantially constant even when sheets are continuously fed at a high speed. Moreover, a phenomenon in which the fixing temperature drops at the start of high-speed fixing operation (so-called a "temperature droop phenomenon") is suppressed. These effects of the maintenance of the fixing temperature and the suppression of the temperature drop phenomenon also hold for the fixing operation especially on heavy paper or the like having high heat capacity. Further, even if the fixing temperature needs to be changed (including both increase and decrease of the fixing temperature) halfway through a printing operation in accordance with types of sheets, such a temperature change is easily performed by adjusting the outputs of the halogen heaters 71 to 73 owing to the low heat capacity of the fixing belt 610.

Further, in the fixing unit 60 of the present exemplary embodiment, the fixing roller 611 is a hard roller made of aluminum, SUS, or the like, while the pressure roller 62 is a soft roller made by covering the elastic layer. Accordingly, in the roller nip portion N1, a nip region having a certain width in the movement direction of the fixing belt 610 is formed by the pressure roller 62 being bent at its surface with the fixing roller 611 being hardly bent. As described above, in the roller nip portion N1, the fixing roller 611 around which the fixing belt 610 is wound is hardly deformed. This allows the fixing belt 610 to pass through the roller nip portion N1 while maintaining its moving speed substantially constant, and thereby restrains wrinkles and deformation from occurring in the fixing belt 610 at the roller nip portion N1. As a result, fixed images with good quality are stably provided.

After passing through the roller nip portion N1, the sheet P is subsequently transported to the peeling pad nip portion N2. At the peeling pad nip portion N2, the pressure roller 62 presses the peeling pad 64, and thereby comes into pressure-contact with the fixing belt 610. Such a configuration causes the peeling pad nip portion N2 to have a shape extending along the contact surface of the peeling pad 64 with the fixing belt 610, the contact surface processed to be substantially flat. Meanwhile, the roller nip portion N1 has a shape curving downward with the curvature of the fixing roller 611.

Due to the above configuration, the sheet P, which has been heated and pressurized with the curved surface of the fixing roller 611 in the roller nip portion N1, is caused to change its movement direction in the peeling pad nip portion N2 along the curved surface of the pressure roller 62, which is opposite to the current direction. In this event, a minute micro-slip occurs between the toner image on the sheet P and the surface of the fixing belt 610. This weakens the adhesion force between the toner image and the fixing belt 610, and thereby makes the sheet P likely to be peeled from the fixing belt 610. In this way, the peeling pad nip portion N2 may be regarded as a region where a preparation step is carried out for ensuring reliable peeling in a final peeling step.

Since the fixing belt 610 is moved so as to be wound around the peeling pad 64 at the exit of the peeling pad nip portion N2, the movement direction of the fixing belt 610 is drastically changed there. In other words, since the fixing belt 610 moves along the outer side surface of the peeling pad 64, the fixing belt 610 is bent to a large extent at the exit of the peeling pad nip portion N2. For this reason, the sheet P, whose adhesion force to the fixing belt 610 has been weakened in advance in the peeling pad nip portion N2, is peeled from the fixing belt 610 by the stiffness of the sheet P itself.

The sheet P having been peeled from the fixing belt 610 is then moved in a direction guided by a peeling guide plate 69 as an example of a peeling guide member which is arranged downstream of the peeling pad nip portion N2. The sheet P having been guided by the peeling guide plate 69 is thereafter transported toward the cooling unit 80 by a sheet exit guide 78 and a sheet exit belt 79 as an example of an exit guide member. In other words, the peeling guide plate 69 is a member for separating the sheet P, which has been peeled from the fixing belt 610, from the fixing belt 610 completely and specifying the movement direction of the sheet P. The sheet exit guide 78 and the sheet exit belt 79 are members for guiding the sheet P, whose movement direction has been specified by the peeling guide plate 69, to the cooling unit 80 smoothly.

The fixing process in the fixing unit 60 is completed with the above-described operation.

<Explanation of Sheet Exit Guide>

Normally, the sheet P having passed through the nip portion N is separated from the fixing belt 610 and transported toward the cooling unit 80 in the above-described manner. The cooling unit 80 then cools the color toner image fixed on the sheet P as described above. Here, because the temperature of the space around the sheet P having passed through the nip portion N is lower than the temperature of the sheet P, the sheet P is cooled and its temperature keeps decreasing even while the sheet P is transported from the nip portion N to the cooling unit 80. In a case where the sheet P is cooled too rapidly due to the temperature of the space around the sheet P, the toner melted in the nip portion N is fixed on the sheet P with its surface melted. In this case, the fixed image possesses gloss more than necessary, and the needlessly high gloss results in higher visibility of uneven melting of toner and graininess of toner particles. In sum, quality of the formed image is degraded. By contrast, in a case where the sheet P is cooled with appropriate temperature transition, the toner melted in the nip portion N is gathered in some parts and fixed on the sheet P with its surface being increased roughness. In this case, the fixed image possesses proper gloss, thus suppressing degradation in image quality.

Against this background, in the present exemplary embodiment, the temperature transition of the sheet P is controlled by providing the sheet exit guide 78 with a thermal-insulation function.

Figure 3:
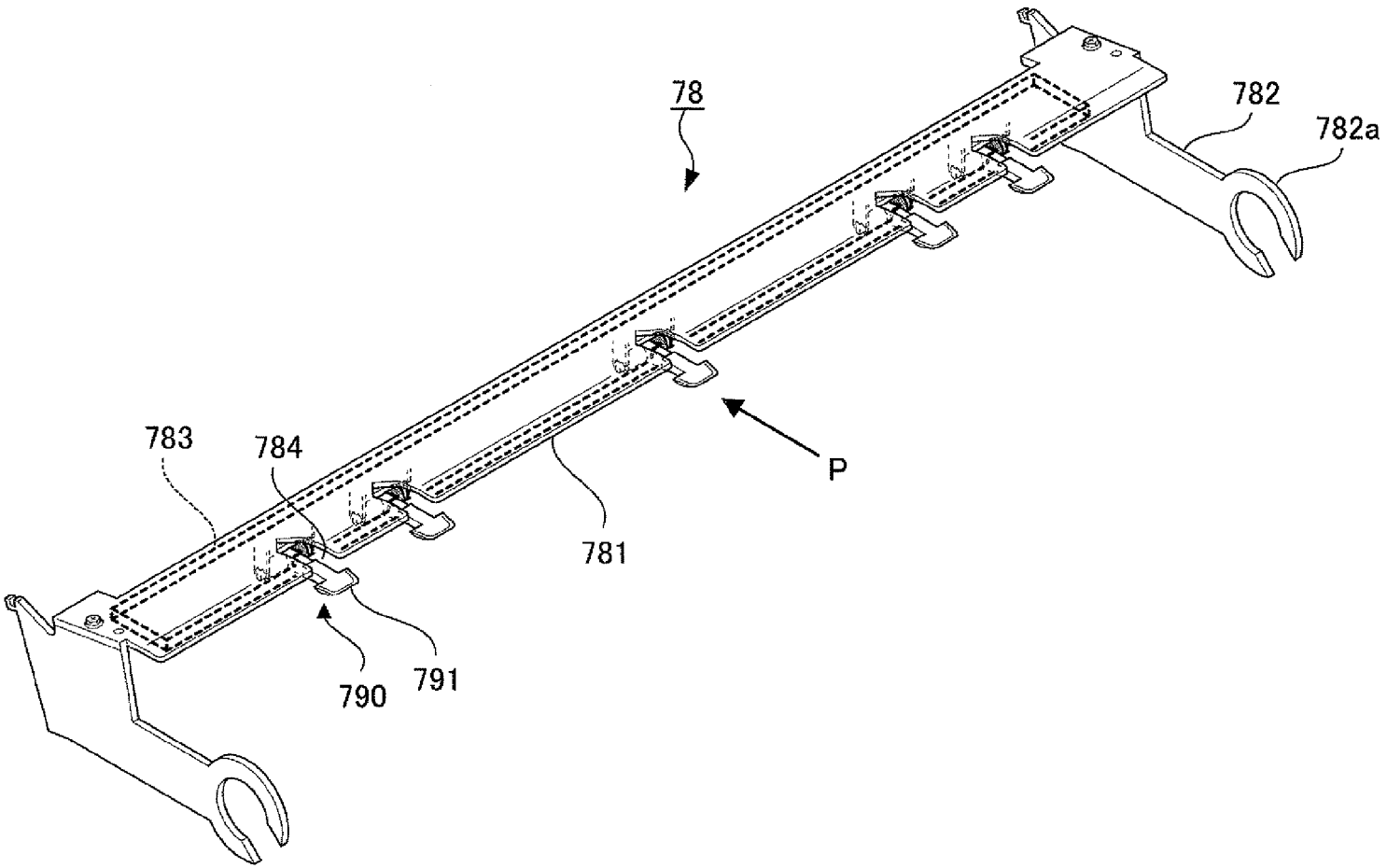
FIG. 3 illustrates the sheet exit guide having a peeling member of the present exemplary embodiment.
Figure 4:
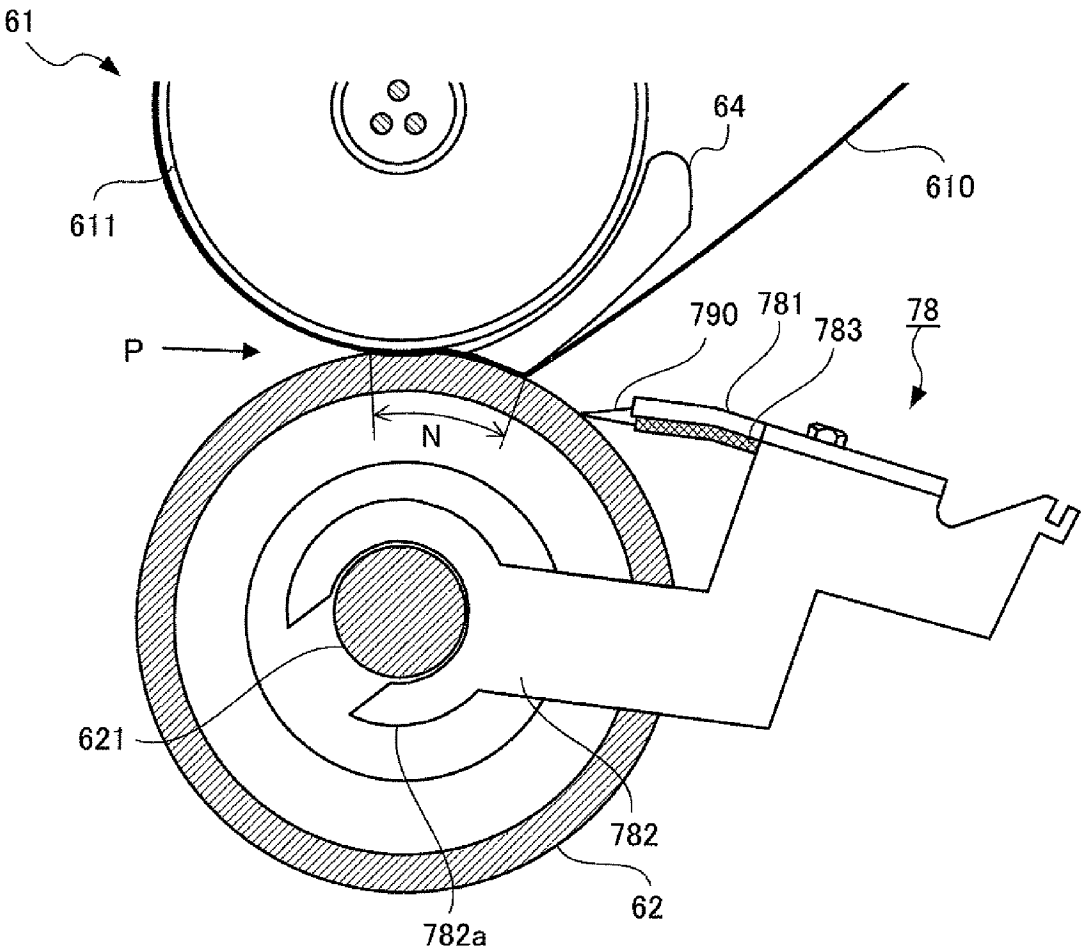
FIG. 4 illustrates how the sheet exit guide of the present exemplary embodiment is actually attached.

FIG. 3 illustrates the sheet exit guide 78 of the present exemplary embodiment. FIG. 4 is a diagram illustrating how the sheet exit guide 78 of the present exemplary embodiment is actually attached. Hereinbelow, the sheet exit guide 78 of the present exemplary embodiment is described with reference to FIGS. 3 and 4.

A main portion of the sheet exit guide 78 shown in FIGS. 3 and 4 is constituted by: a guide plate 781 as an example of a plate portion which is used for guiding the sheet P having passed through the nip portion N; attachment portions 782 which are arranged below the guide plate 781 and used for fixing the sheet exit guide 78 itself; and a thermal-insulation member 783 which is arranged on a rear surface of the guide plate 781 opposite to the front surface thereof that comes into contact with the sheet P.

The guide plate 781 is a member for guiding and transporting the outputted sheet P on its upper surface to the sheet exit belt 79. In the present exemplary embodiment, the guide plate 781 has five notches 784 opening on a side closer to the pressure roller 62. Peeling claws 790 are arranged and held at positions of the respective notches 784 for peeling off the sheet P adhering to the pressure roller 62. The peeling claws 790 are used for preventing the sheet P, which has been outputted from the fixing unit 60 while adhering to the pressure roller 62, from winding around the pressure roller 62 and thus causing a sheet jam. To be more specific, the peeling claws 790 have respective claw portions 791 at their tips. In the present exemplary embodiment, the peeling claws 790 are urged toward the pressure roller 62 by an unillustrated elastic member such as a spring member. As a consequence, the claw portions 791 of the respective peeling claws 790 are brought into close contact with the pressure roller 62 by a predetermined pressure. When the sheet P is transported while adhering to the pressure roller 62 in this state, the tip of each claw portion 791 is inserted between the pressure roller 62 and the sheet P, thereby separating the sheet P from the pressure roller 62. Then, the sheet P thus peeled is guided by the top surface of each claw portion 791 and sent to the guide plate 781 for further transportation.

The attachment portions 782 each have a tip portion 782*a* in the form of an arc. As shown in FIG. 4, the attachment portions 782 are coupled to a part of a rotational shaft 621 of the pressure roller 62 at their respective tip portions 782*a* so that the entire sheet exit guide 78 may be rotatably fixed about the tip portions 782*a*. Normally, the sheet exit guide 78 is fixed at a position predetermined for peeling the sheet P off the pressure roller 62. If a sheet jam or the like occurs near the sheet exit guide 78, the sheet exit guide 78 is rotated about the tip portions 782*a* from the fixed position so as to be retracted therefrom. Then, the jammed sheet P may be removed after the sheet exit guide 78 is retracted.

The thermal-insulation member 783 is a member for keeping the temperature of the guide plate 781 by preventing heat, which is outputted mainly from the fixing unit 60 (see FIG. 2), from leaking out. To meet this purpose, the thermal-insulation member 783 is made of a material suitable for thermal insulation, such as resin, and arranged over the entire rear surface of the guide plate 781. The thermal-insulation member 783 is attached to the rear surface of the sheet exit guide 78 with an adhesive or the like to be fixed thereon. The arrangement of the thermal-insulation member 783 in this manner allows the guide plate 781 to keep its temperature higher than that in a case where no thermal-insulation member 783 is provided. This allows the sheet P outputted from the nip portion N to pass through the guide plate 781 while keeping high temperature. Concretely, in the case where the thermal-insulation member 783 is provided, the sheet P may be transported while being kept at a temperature 5° C. to 15° C. higher than that in the case where no thermal-insulation member 783 is provided, for example.

In sum, by arranging the thermal-insulation member 783 on the guide plate 78, the sheet P may be transported to the cooling unit 80 while its temperature is kept high. Accordingly, the fixed toner image may be prevented from becoming too glossy due to too fast cooling, and thus degradation in image quality may be suppressed. In other words, image quality may be ensured by suppressing gloss of the fixed toner image.

<Explanation of Heating Part Controller>

In the present exemplary embodiment, the temperature transition of the sheet P is controlled further accurately by controlling the outputs of the halogen heaters 74, which are an example of the pressure member heating unit for heating the pressure roller 62 (see FIG. 2), and thereby adjusting the surface temperature of the pressure roller 62. In other words, the temperature of the sheet P immediately after the sheet passes through the nip portion N may be controlled by adjusting the surface temperature of the pressure roller 62. The temperature of the sheet at this time relates to the temperature transition, so that the temperature transition of the sheet may be controlled by this temperature control.

Figure 5:
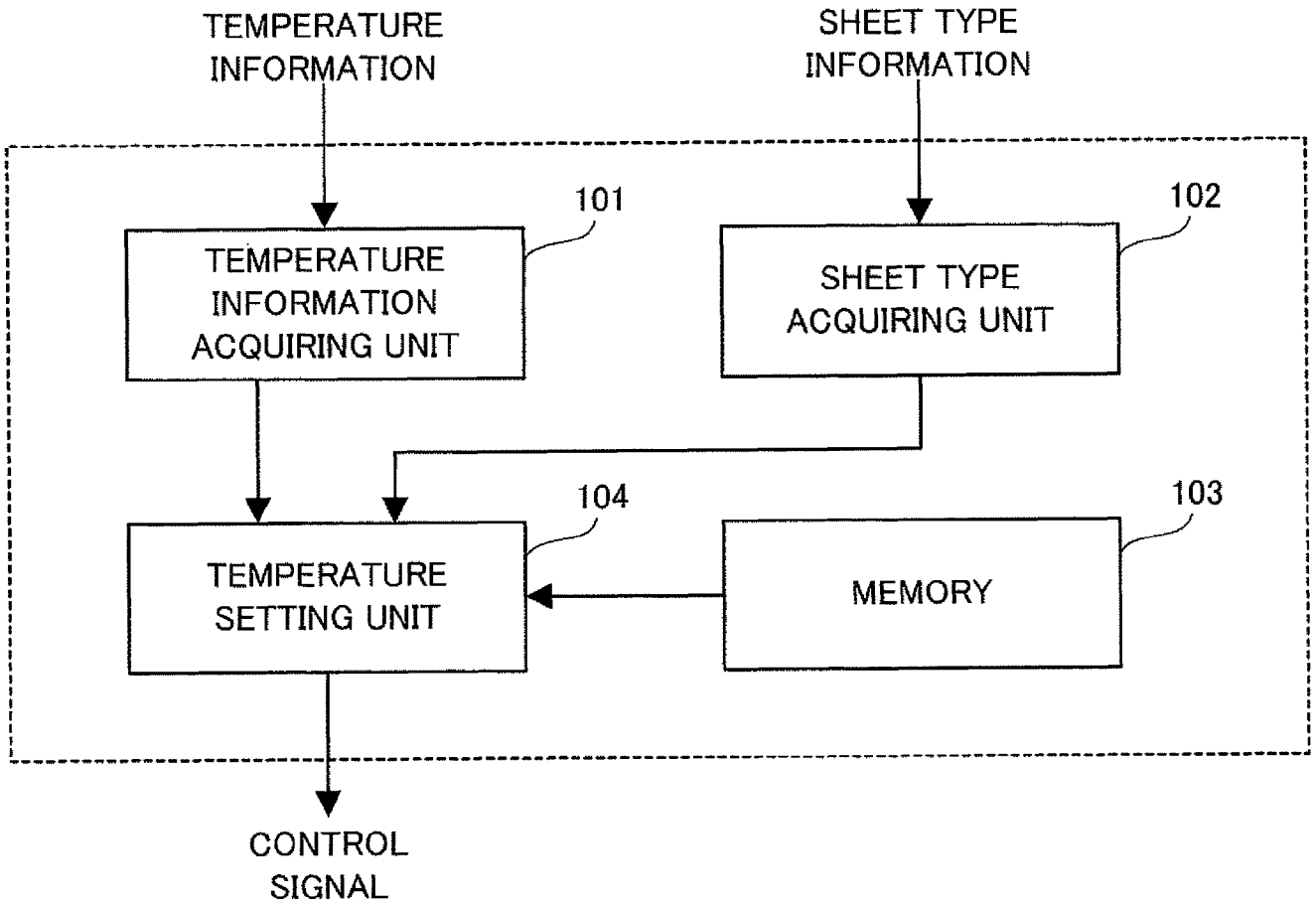
FIG. 5 is a block diagram illustrating a configuration of a heating unit controller which controls the outputs of the halogen heaters.
Figure 6:
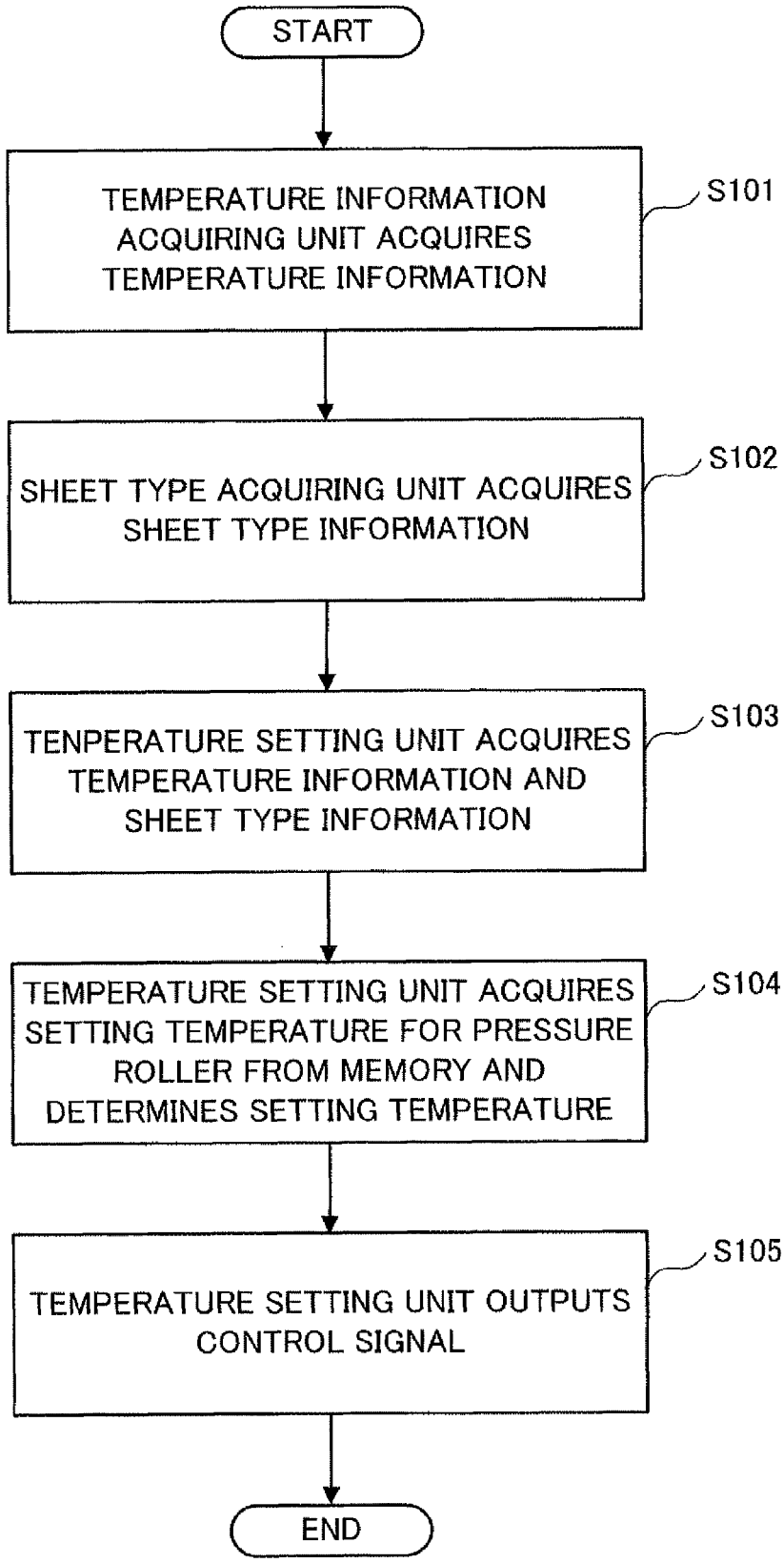
FIG. 6 is a flowchart illustrating an operation flow of the heating unit controller.

FIG. 5 is a block diagram illustrating a configuration of a heating unit controller which controls the outputs of the halogen heaters 74. FIG. 6 is a flowchart illustrating an operation flow of the heating unit controller.

As shown in FIG. 5, the heating unit controller includes: a temperature information acquiring unit 101 which acquires temperature information; a sheet type acquiring unit 102 as an example of a recording medium type acquiring portion which acquires sheet type information; a memory 103 which stores the relation between a temperature to be set for the pressure roller 62, and the temperature and sheet type information; and a temperature setting unit 104 which acquires the temperature information and the sheet type information from the temperature information acquiring unit 101 and the sheet type acquiring unit 102, respectively, and acquires, from the memory 103, information on the setting temperature for the pressure roller 62 that corresponds to the acquired temperature and sheet type information.

The operation of the heating unit controller is described below by use of FIGS. 5 and 6.

First, the temperature information acquiring unit 101 acquires temperature information (Step 101). The temperature information that the temperature information acquiring unit 101 acquires here is information on the temperature of the guide plate 781 (see FIG. 3), for example. Alternatively, information on a temperature other than the temperature of the guide plate 781 may be acquired as the temperature information as long as the alternative temperature corresponds to the temperature of the guide plate 781. Examples of the alternative temperature include: the temperature of the space around the guide plate 781; the surface temperature of the pressure roller 62; and a combination of these.

Next, the sheet type acquiring unit 102 acquires sheet type information (Step 102). The sheet type information mentioned here is information on the model number of a sheet, for example. Alternatively, information on the size and thickness of the sheet or the heat capacity of the sheet may be acquired as the sheet type information due to the following reason. Specifically, the heat capacity of the sheet is one of factors for determining the temperature transition of the sheet, and is thus may be used for predicting the temperature transition of the sheet. Hence, the information on the heat capacity of the sheet is important for the temperature setting unit 104 to set the setting temperature for the pressure roller 62, and is expected to be used for more accurate control on the temperature transition. Moreover, the heat capacity of the sheet relates to the size and thickness thereof, and thus the size and thickness information is also important in setting the setting temperature for the pressure roller 62. The sheet type information may be automatically detected by the image forming apparatus 1, for example, or may be inputted by the user operating the image forming apparatus 1.

Subsequently, the temperature setting unit 104 acquires the temperature information and the sheet type information from the temperature information acquiring unit 101 and the sheet type acquiring unit 102, respectively (Step 103). The temperature setting unit 104 having acquired the temperature and sheet type information then acquires the setting temperature for the pressure roller 62 corresponding to the temperature and sheet type information from the memory 103, and thereby determines the setting temperature for the pressure roller 62 (Step 104). Thereafter, the temperature setting unit 104 outputs a control signal for controlling the halogen heaters 74 (Step 105).

It should be noted that, for controlling the temperature transition of the sheet P, it is not sufficient to adjust the surface temperature of the pressure roller 62 and thereby adjusts the temperature of the sheet P by controlling the halogen heaters 74 serving as the pressure member heating unit of the pressure roller 62. Specifically, since the optimum fixing temperature range of the pressure roller 62 is fixed in advance, it is difficult to perform control such that the surface temperature of the pressure roller 62 may be adjusted beyond this temperature range. This inhibits sufficient control on the surface temperature of the pressure roller 62 for the control on the temperature transition of the sheet P.

In the aforementioned example, the temperature transition of the sheet is controlled by controlling the outputs of the halogen heaters 74 placed inside the pressure roller 62 and thereby controlling the surface temperature of the pressure roller 62. However, the control method is not limited thereto.

For example, the temperature transition of the sheet may be controlled by controlling the surface temperatures of the inner heating roller 612 as the inner heating unit and the outer heating roller 613 as the outer heating unit, in addition to the aforementioned example. In this case, control is also performed on the outputs of the halogen heaters 72 placed inside the inner heating roller 612 and the halogen heaters 73 placed inside the outer heating roller 613. This control may also be performed by the heating unit controller, as in the case of the aforementioned example.

The heating unit controller may be placed inside the fixing unit 60 (see FIG. 2), or placed inside the image forming apparatus 1 (see FIG. 1) but outside the fixing unit 60. When placed inside the image forming apparatus 1 but outside the fixing unit 60, the heating unit controller may be provided as a part of the main controller 50 (see FIG. 1).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes a toner image on a recording medium;

a pressure member that comes into pressure-contact with an outer peripheral surface of the fixing member and thereby forms a fixing pressure portion between the pressure member and the fixing member, the fixing pressure portion allowing the recording medium carrying an unfixed toner image to pass therethrough;

a tension member that is arranged to face the pressure member with the fixing member interposed therebetween, and tensions the fixing member;

a peeling member that is arranged at a position downstream of the fixing pressure portion in a recording medium transport direction and adjacent to the tension member, and peels the recording medium from the fixing member; and an exit guide member that guides the recording medium while keeping a temperature of the recording medium, after the recording medium passes through the fixing pressure portion, wherein the exit guide member includes:

a plate portion that guides the recording medium; and a thermal-insulation member that is provided on a rear surface of the plate portion, the rear surface being opposite to a surface on which the recording medium passes, and wherein the exit guide member is not in contact with the fixing member and the pressure member which constitute a nip portion.

2. The fixing device according to claim 1, further comprising:

a pressure member heating unit that heats the pressure member; and a heating unit controller that adjusts the temperature of the recording medium by controlling the pressure member heating unit.

3. The fixing device according to claim 2, further comprising:

an inner heating unit that heats an inner side of the fixing member; and an outer heating unit that heats an outer side of the fixing member, wherein the heating unit controller adjusts the temperature of the recording medium by controlling temperatures of the inner heating unit and the outer heating unit.

4. The fixing device according to claim 2, wherein the heating unit controller includes a recording medium type acquiring portion that acquires a type of the recording medium, and controls the pressure member heating unit on the basis of the type of the recording medium.

5. The fixing device according to claim 3, wherein the heating unit controller includes a recording medium type acquiring portion that acquires a type of the recording medium, and controls the pressure member heating unit on the basis of the type of the recording medium.

6. An image forming apparatus comprising:

a toner image forming unit that forms a toner image;

a transfer unit that transfers the toner image on a recording medium, the toner image formed by the toner image forming unit;

a fixing unit that includes:

a fixing member that fixes the toner image on the recording medium;

a pressure member that comes into pressure-contact with an outer peripheral surface of the fixing member and thereby forms a fixing pressure portion between the pressure member and the fixing member, the fixing pressure portion allowing the recording medium carrying an unfixed toner image to pass therethrough, a tension member that is arranged to face the pressure member with the fixing member interposed therebetween, and tensions the fixing member, and a peeling member that is arranged at a position downstream of the fixing pressure portion in a recording medium transport direction and adjacent to the tension member, and peels the recording medium from the fixing member; and an exit guide member that guides the recording medium while keeping a temperature of the recording medium, after the recording medium passes through the fixing pressure portion, wherein the exit guide member includes:

a plate portion that guides the recording medium; and a thermal-insulation member that is provided on a rear surface of the plate portion, the rear surface being opposite to a surface on which the recording medium passes, and wherein the exit guide member is not in contact with the fixing member and the pressure member which constitute a nip portion.

* * * * *